United States Patent [19]

Kelly, Jr.

[11] 3,995,701

[45] Dec. 7, 1976

[54] DERRICK TILTING SYSTEM

[75] Inventor: Joseph L. Kelly, Jr., Houston, Tex.

[73] Assignee: Hughes Tool Company, Houston, Tex.

[22] Filed: Apr. 7, 1975

[21] Appl. No.: 565,991

[52] U.S. Cl. ..... 173/43; 52/116; 173/29; 173/145; 173/163; 248/2

[51] Int. Cl.[2] ..... E21B 3/02; E21B 15/00

[58] Field of Search ..... 173/40, 41, 43, 28, 173/152, 29, 46, 42, 44, 145, 159, 160; 248/16, 2; 52/116

[56] References Cited

UNITED STATES PATENTS

| | | | |
|---|---|---|---|
| 2,686,040 | 8/1954 | Lear | 173/43 X |
| 3,695,363 | 10/1972 | Kelly, Jr. | 173/43 |
| 3,780,816 | 12/1973 | Arrington et al. | 173/152 |
| 3,850,253 | 11/1974 | Lupton et al. | 173/28 X |

*Primary Examiner*—Ernest R. Purser
*Assistant Examiner*—William F. Pate, III
*Attorney, Agent, or Firm*—Robert A. Felsman

[57] ABSTRACT

A shaft drilling machine generally includes a pivotable power swivel supported on a drilling assembly moved along a mast by hydraulic cylinders. Improved means for positioning the mast include a screw jack assembly with one end adapted to be secured to the power swivel and the other end secured to the base of the machine.

5 Claims, 3 Drawing Figures

24
41
43
45
47
49
51
53
55
57
59
61
63
65
67
69
71
73
75
77
78
79
81
83
85
87
89
91
93
95
97
98
99
100
101
102
103
105
107
109
110
111
113
117
119
121
123
125
127
129
131
133
135

DERRICK TILTING SYSTEM

BACKGROUND OF THE INVENTION

1. Field of the Invention

This invention relates in general to earth boring and in particular to means for positioning the mast of an earth boring machine.

2. Description of the Prior Art

In the earth boring arts, hydraulically operated shaft drilling machines are known. (See U.S. Pat. No. 3,695,363, "Rotary Shaft Drilling Apparatus," Joseph L. Kelly, Jr., Oct. 3, 1972.) Such machines have masts that are raised, lowered and selectively positioned to drill holes at various angles. Hydraulic cylinders move a drilling assembly along the mast, and the assembly uses a hydraulically powered swivel to rotate pipe which supports the drill bit. One technique for positioning the mast is shown in U.S. Pat. No. 3,563,332, "Earth Boring Machine Positioning System," issued to James W. Young, Feb. 16, 1971. In general this patent teaches a system for positioning the mast by attaching a fixed linkage between the base and drilling assembly, which when moved linearly by the hydraulic cylinders changes the angular position of the mast.

SUMMARY OF THE INVENTION

In hydraulically operated earth boring machines of the type generally described above, improved means for positioning the mast comprises a screw jack assembly with one end adapted to be secured to the power swivel and the other end pivotally secured to the base. When the screw jack is rotated by the power swivel, the jack is shortened or lengthened to move the mast to new positions. In the preferred embodiment, the screw jack assembly comprises a barrel attached to the power swivel and a screw which mates with threads in the barrel and which is pivotally attached to the base. A fixed link secures the mast and base in a selected position, and the barrel can then be disconnected and the screw jack assembly placed in an inactive position.

DESCRIPTION OF THE PREFERRED EMBODIMENT

Figure 1:
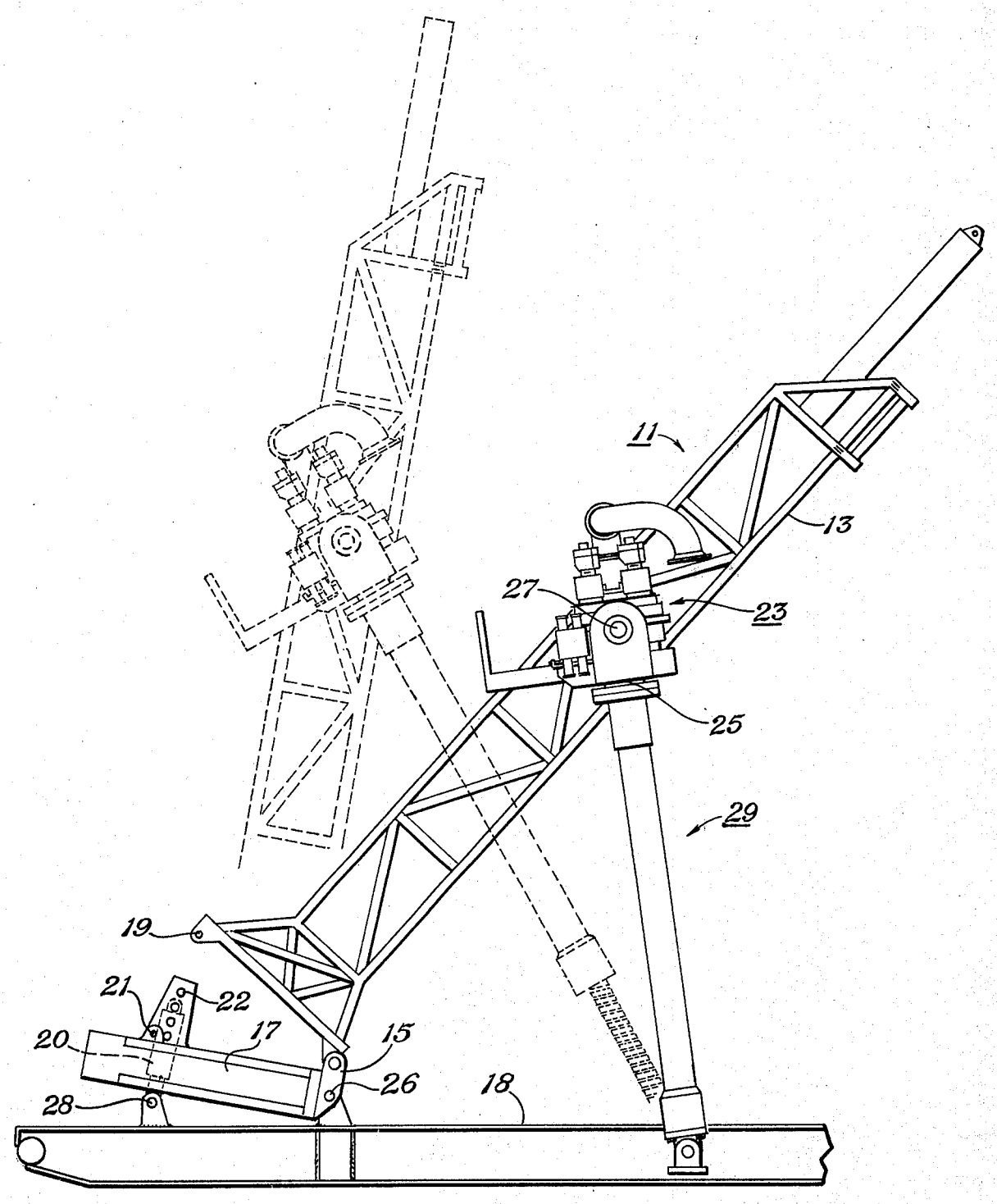
FIG. 1 is a side elevation view, partially in section, of a shaft drilling machine, illustrating two of the many possible positions which the mast and associated screw jack assembly may assume.

The numeral 11 in the drawing designates a shaft drilling machine in general having a mast 13 pivotally secured at 15 to an adjustable base 17 pivotally secured to fixed base 18 at 26. Bases 17 and 18 are further secured to one another by adjustable link 20 and pins 22 and 28. A releaseable connection means or pin (not shown) is inserted through apertures 19 and 21 when mast 13 is in the drilling attitude. If mast 13 must be tilted relative to base 17 to provide clearance for insertion of drilling tools and the like into the hole, the pin passing through apertures 19 and 21 is removed and the mast inclined as illustrated. When the base 17 and mast are to be aligned with the axis of the hole being drilled as a unit, pin 22 is removed, the mast and base assembly inclined and the adjustable link 20 is lengthened or shortened to permit reinsertion of pin 22.

A drilling assembly 23 is moved reciprocally along the mast by suitable means such as hydraulic cylinders 24 (see FIG. 3) to raise and lower the drill pipe and bit (not shown). A power swivel 25 is pivotally secured in said drilling assembly at 27.

Figure 2:
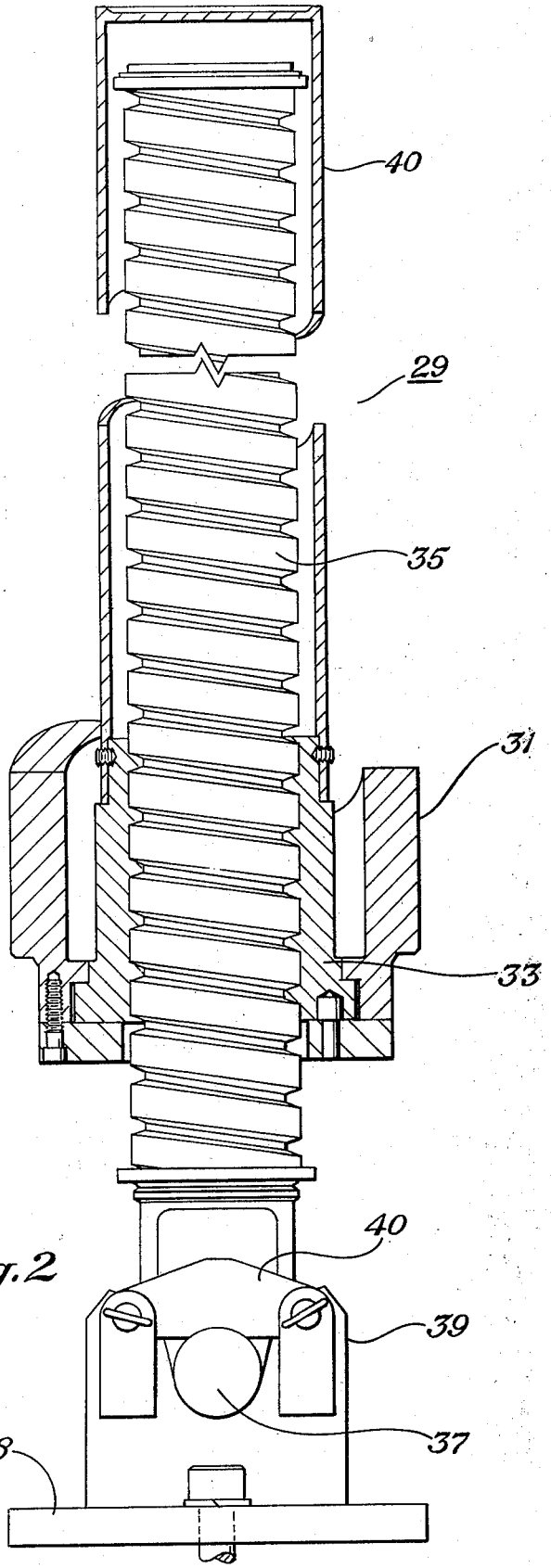
FIG. 2 is a side elevation view, partially in section, of the screw jack assembly and connection means for attachment to the base of the machine.

As shown in FIG. 1, a screw jack assembly 29 may be attached to a threaded pin (not shown) of the swivel. As shown in FIG. 2, the screw jack assembly includes a barrel 31 having a threaded lower end 33 which engages the threads of a screw 35 pivotally attached at 37 such that it may be released from connection means 39 secured to the base 18 by fasteners as indicated. The upper end of the barrel has coupling means or threads for coupling with the threaded pin of the swivel. Cover 40 protects screw 35 from contamination.

Figure 3:
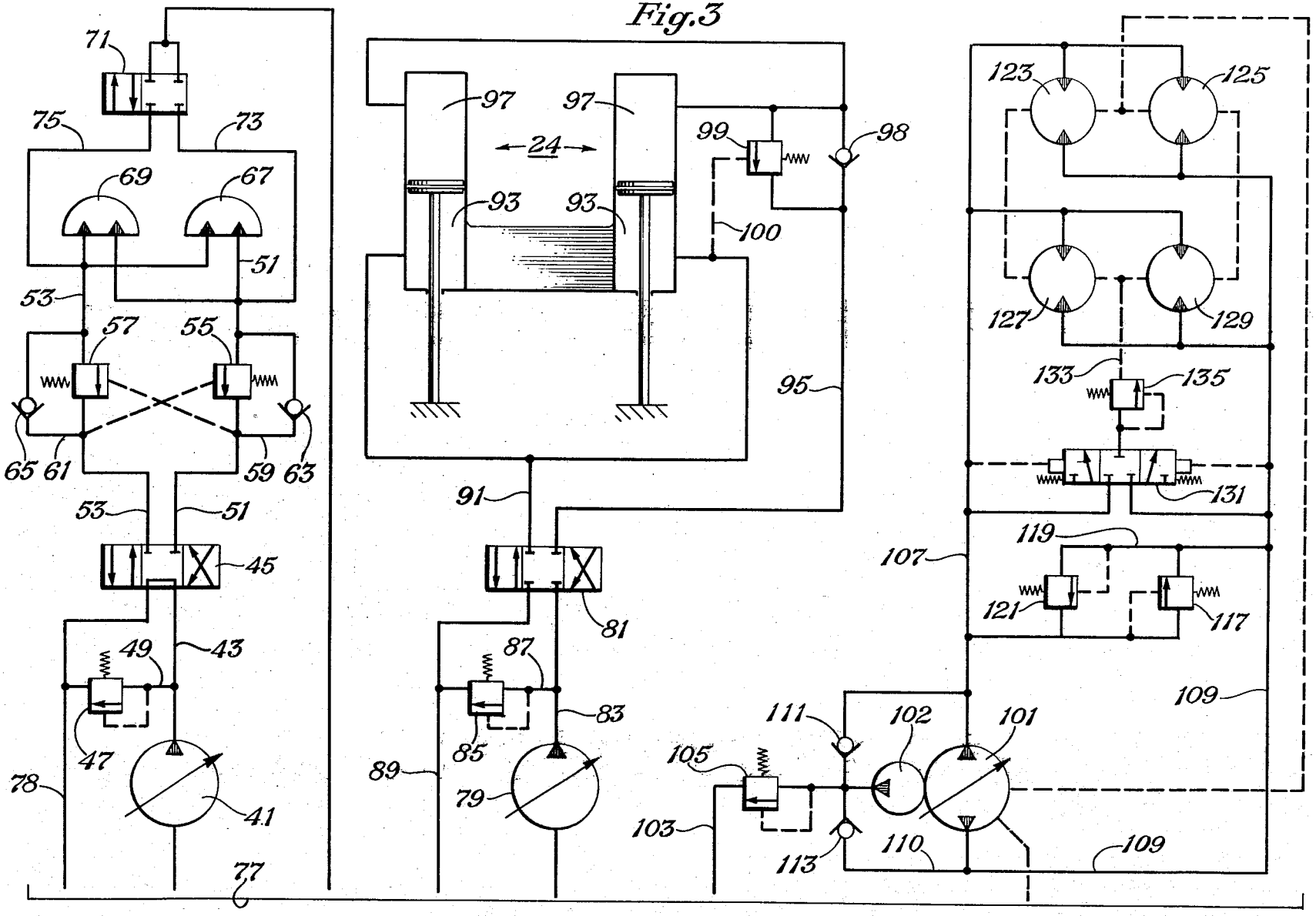
FIG. 3 is a schematic diagram of hydraulic circuitry preferably used with the machine.

Control means for the previously described apparatus are shown schematically in FIG. 3. The left-hand portion of the diagram illustrates a rotary actuator circuit with independent neutral. The pump 41 supplies fluid through lines 43 to a three-position, four-way valve 45 and a pressure relief valve 47 that when actuated permits fluid to by-pass the valve through hydraulic line 49. Four-way valve 45 directs fluid through lines 51, 53, through counter-balance valves 55, 57 which may be by-passed respectively through lines 59, 61 through check valves 63, 65. Fluid may flow thus to a pair of rotary actuators 67, 69 and to a two-position, four-way closed center valve 71 through lines 73 or 75. Fluid returns to a sump 77 from return line 78.

The central portion of the schematic diagram in FIG. 3 is a hydraulic cylinder circuit by which a pump 79 supplies a second three-position, four-way valve 81 through line 83 provided with pressure relief through valve 85 and line 87 to the fluid return line 89. Line 91 supplies fluid into the lower regions 93 of the two parallel hydraulic cylinders illustrated, while line 95 supplies fluid to the upper regions 97 of the cylinders through check valve 98. When fluid is being exhausted from upper regions 97, it flows through counter-balance valve 99, which is piloted by the pressure in lower regions 93 through line 100.

The right-hand portion of the diagram in FIG. 3 illustrates a closed loop pump motor control circuit by which a reversible pump 101 supplies fluid to line 107 or 109 respectively. Charge pump 102 supplies fluid to lines 108 and 110 to compensate for leakage. Relief valve 105 maintains charge pressure and exhausts unused fluid through line 103 to sump 77.

Lines 107 and 109 are connected through lines 115 and 119 to relief valves 117 and 121 for protection against excessive pressure. Lines 107, 109 also feed motors 123, 125, 127 and 129 as shown. Further, lines 107 and 109 are connected to an automatically actuated three-position, three-way shuttle valve 131 which provides an exhaust path for excessive fluid in the low pressure side of the motor circuit through a line 133, through a relief valve 135, through the motor and pump cases and a pump drain to sump 77.

In operation, the drilling assembly 23 is positioned along the mast with the hydraulic cylinders 24, which are extended or retracted by positioning valve 81 to control the flow of fluid from pump 79 to and from the lower and upper regions 93, 97 of the cylinders. When drilling is in progress, the drill pipe axis is aligned with that of the mast 13 and is perpendicular to adjustable base 17. The drilling operation as well as the adding and subtracting of drill pipe is performed in the manner described in U.S. Pat. No. 3,695,363.

To tilt the mast, the upper end of the barrel 31 of screw jack assembly 29 is fastened to the power swivel 25 in the same manner as drill pipe. The swivel is positioned along the mast at a predetermined position by supplying fluid to the hydraulic cylinders 24 through valve 81 and pump 79. Valve 81 is then placed in neutral so the cylinders can no longer move the swivel. Tilting or pivoting of the swivel is achieved by supplying fluid to the rotary actuators 67, 69 through valve 45 by pump 41. When the pivot pin 37 attached to screw 35 of the screw jack assembly 29 is properly positioned, the latch 40 of connection means 39 is used to retain the pin 37. Valve 71 is then shifted to allow the swivel to pivot freely independent of valve 45 and pump 41. The pin passing through apertures 19 and 21 or the pin 22 is then removed. Rotation of the barrel 31 and hence extension or retraction of the screw jack assembly is accomplished by feeding fluid from reversible pump 101 to the motors 123 – 129. When the proper angle of the mast 13 is achieved, rotation of the motors 123 – 129 is ceased. If the mast is being positioned for drilling, adjutable link 20 is adjusted to the proper length, releasable pin 22 is inserted in an appropriate aperture to rigidly secure the mast in the selected position. Thereafter, the screw jack assembly may be removed and placed in an inactive position while drilling proceeds at the selected angle.

While the invention has been shown in only one of its forms, it should be apparent to those skilled in the art that it is not thus limited but is susceptible to various changes and modifications without departing from the spirit thereof.

Numeral Check List

| | | | |
|---|---|---|---|
| 11 | shaft drilling machine | | |
| 13 | mast | | |
| 15 | pivotally secured | | |
| 17 | adjustable base | | |
| | | 18 | fixed base |
| 19 | releaseable pin | | |
| | | 20 | adjustable link |
| 21 | aperture | | |
| | | 22 | pin |
| 23 | drilling assembly | | |
| | | 24 | hydraulic cylinder |
| 25 | hydraulic power swivel | | |
| | | 26 | pin |
| 27 | pin | | |
| | | 28 | pin |
| 29 | screw jack assembly | | |
| 31 | barrel | | |
| 33 | threaded lower end | | |
| 35 | screw | | |
| 37 | pivot | | |
| 39 | connection means | | |
| | | 40 | cover |
| 41 | reversible pump | | |
| 43 | line | | |
| 45 | 2 position/4 way valve | | |
| 47 | relief valve | | |
| 49 | line | | |
| 51 | line | | |
| 53 | line | | |
| 55 | counter balance valves | | |
| 57 | counter balance valves | | |
| 59 | line | | |
| 61 | line | | |
| 63 | check valve | | |
| 65 | check valve | | |
| 67 | rotary actuators | | |
| 69 | rotary actuators | | |
| 71 | 2 position/4 way, closed center valve | | |
| 73 | line | | |
| 75 | line | | |
| 77 | sump | | |
| 78 | return line | | |
| 79 | sump | | |
| 81 | 2nd 2 position/4 way valve | | |
| 83 | line | | |
| 85 | pressure relief valve | | |
| 87 | line | | |
| 89 | return line | | |
| 91 | line | | |
| 93 | lower region of cylinders | | |
| 95 | line | | |
| 97 | upper region of cylinders | | |
| | | 98 | check valve |
| 99 | pressure relief valve | | |
| 100 | line | | |
| 101 | reversible pump | | |
| | | 102 | charge pump |
| 103 | line | | |
| 105 | pressure relief valve | | |
| 107 | line | | |
| | | 108 | line |
| 109 | line | | |
| 111 | check valve | | |
| 113 | check valve | | |
| 115 | line | | |
| 117 | relief valve | | |
| 119 | line | | |

-continued

| Numeral Check List | |
|---|---|
| 121 | relief valve |
| 123 | pump |
| 125 | pump |
| 127 | pump |
| 129 | pump |
| 131 | 3 position/3 way shuttle valve |
| 133 | line |
| 135 | relief valve |

I claim:

1. An improved earth boring machine of the type having a base, a mast pivotally secured to the base, a drilling assembly reciprocally carried by the mast, hydraulic means to move the assembly along the mast, and a power swivel pivotally carried by said assembly, the improvement comprising:

a screw jack assembly pivotally connected at one end to the base; and coupling means for coupling the other end of the screw jack assembly to the power swivel for rotational movement therewith while the mast is being positioned at a selected angle with respect to the base; said coupling means being releasble for drill pipe connection to the power swivel after the mast is positioned at the selected angle.

2. The machine of claim 1 which further comprises means rigidly securing the mast and base after positioning by the screw jack assembly.

3. The machine of claim 1 in which hydraulic means are used to pivot the power swivel, said means permitting free pivotal movement of the swivel as the mast is tilted.

4. In an earth boring machine of the type having a base, a mast pivotally secured to the base, a drilling assembly reciprocally carried by the mast, hydraulic means to move the assembly along the mast, and a power swivel pivotally carried by said assembly, an improved screw jack assembly for positioning the mast at a selected angle with respect to the base, comprising:

a barrel, having coupling means at one end for coupling the barrel to the power swivel for rotational movement therewith, and a threaded aperture at the other end;

a screw engaged at one end by the threaded aperture and pivotally connected at its other end to the base, whereby rotation of the barrel by the power swivel varies the length of the screw jack assembly for positioning the mast;

said coupling means being releasable so as to allow drill pipe to be connected to the power swivel after the mast is positioned at the selected angle.

5. An improved earth boring machine with improved means for positioning its mast, said machine comprising:

a fixed base;

an adjustable base pivotally secured to the fixed base;

an adjustable link pivotally connected at one end to the fixed base and pivotally connected at the other end to the adjustable base for positioning the adjustable base with respect to the fixed base;

a mast pivotally secured on one side to the adjustable base;

releasable connection means for rigidly securing the other side of the mast to the adjustable base, whereby the mast may be tilted by removing the connection means without disturbing the orientation of the adjustable base;

a drilling assembly reciprocably carried by the mast;

hydraulic means to move said assembly along the mast;

a power swivel pivotally carried by said assembly;

a screw jack assembly pivotally connected at one end to the fixed base; and coupling means for coupling the other end of the screw jack assembly to the power swivel for rotational movement therewith while the mast is being positioned at a selected angle with respect to the base; said coupling means being releasable so as to allow drill pipe to be connected to the power swivel after the mast is positioned at the selected angle.

* * * * *